United States Patent [19]

Takeuchi

[11] Patent Number: 4,854,602

[45] Date of Patent: Aug. 8, 1989

[54] CASE SUCH AS SUITCASE AND ITS IMPROVEMENT

[75] Inventor: Tadao Takeuchi, Tokyo, Japan

[73] Assignee: Matsuzaki Seisan Kabusiki Kaisha, Tokyo, Japan

[21] Appl. No.: 142,723

[22] Filed: Jan. 11, 1988

[30] Foreign Application Priority Data

| | | | |
|---|---|---|---|
| Jan. 9, 1987 | [JP] | Japan | 62-1862 |
| Jan. 13, 1987 | [JP] | Japan | 62-3443 |
| Jan. 13, 1987 | [JP] | Japan | 62-3442 |
| Jan. 13, 1987 | [JP] | Japan | 62-3444 |
| Feb. 28, 1987 | [JP] | Japan | 62-29656 |

[51] Int. Cl.[4] ..... B62B 1/00

[52] U.S. Cl. ..... 280/79.11; 190/122

[58] Field of Search ..... 280/37, 47.13 R, 47.1, 280/47.34, 79.1 R, 79.1 A; 16/30, 38, 39, 31 R; 190/102, 122, 127

[56] References Cited

U.S. PATENT DOCUMENTS

| | | | |
|---|---|---|---|
| Re. 29,036 | 11/1976 | Hagar | 280/37 |
| 4,418,804 | 12/1983 | Bradley et al. | 280/37 |
| 4,422,212 | 12/1983 | Sheiman et al. | 280/37 |

*Primary Examiner*—Charles A. Marmor
*Assistant Examiner*—Richard Lamb

[57] ABSTRACT

The invention is a suitcase with peripheral protector frames around the mouth of a suitcase with casters secured to the protector frames through plastic boards mounted by screws extending into mountain shaped ridges in the castor body.

3 Claims, 12 Drawing Sheets

CASE SUCH AS SUITCASE AND ITS IMPROVEMENT

BACKGROUND OF THE INVENTION

1. Field of the invention

This invention relates to a case such as a suitcase with a protector, a suitcase with an improved means for mounting an inner band, an improvement of an inner lid device in a case such as suitcase, a suitcase with an improved methods of mounting a castor and a rear castor device in a suitcase.

2. Prior art

There are various shapes for a case with a protector, as known in the prior art. However, there are the following problems with these shapes; (1) The protector is often attached in biased state during the manufacture, resulting often in awkwardness, (2) it is difficult to correctly position the protector during sticking, (3) an adhesive is coated onto an unnecessary location unless said positioning is completed only by one time trial, (4) time and labor may be spent in case of (3), (5) the commercial value of the product deteriorates after (4) because of a trace remaining even after completion of removing, (6) the lateral force of adhesion for the sticked protector is small, (7) the sticked protector is easily peeled off, (8) the shock absorptive force of the protector is not large, etc.

One object of the present invention is to provide a case with a protector without these defects.

Conventionally, a suitcase was composed by fixing both ends of an inner band directly to a fringe-like frame.

Therefore, the head of a crimp rivet with a conventional suitcase was exposed to the outside with poor appearance. In addition, there was a wide space between the bottom wall of a body member or the ceiling wall of a lid member and an inner band while maintaining a fixing position for contents at an upper position.

Another object of this invention is to offer a suitcase without the foregoing defects.

With a conventional case having an inner lid, various connecting systems for inner lid plates 64, 64' were known in the prior art; top end fringe portions 63, 63' were connected with male and female hooks or a string or a belt, etc. However, the former method was inconvenient in that a quantity of overlapping in top end fringe portions 63, 63' was not always adjustable according to the volume of contents. The latter method was free from such inconvenience but difficult to use because string or belt connecting operation, namely binding or metal fitting tightening operation was required.

Therefore, another object of the present invention is to present an inner lid device of easy operation.

According to the prior art, there were various methods for fixing castor to a conventional suitcase; for example, a panel of mounting castors was attached to the outer surface of a ground side wall in a body member and a lid member, while mounting screws were screwed in from the outer side into mounting holes previously equipped on the mounting panel and tops of said mounting screws being screwed in the body and lid members. In such a method known in the prior art, there was no cushion portion between the body and lid members and the castor mounting panel. Therefore, it was not possible to completely avoid damage occurring due to shocks by placing the suitcase on the ground.

Still another object of this invention is to provide a rear wheel device in a suitcase, with which such a problem as described above has been solved.

BRIEF DESCRIPTION OF THE DRAWINGS

FIG. 1 is a general oblique view.

FIG. 2 gives a general oblique view with the lid opened.

FIG. 3 is an enlarged sectional view at line III—III of FIG. 1.

FIG. 4 shows an exploded oblique view of the body side planar member.

FIG. 5 shows an exploded oblique view of the lid side planar member.

DETAILED DESCRIPTION AND THE PREFERRED EMBODIMENTS

Figure 1:
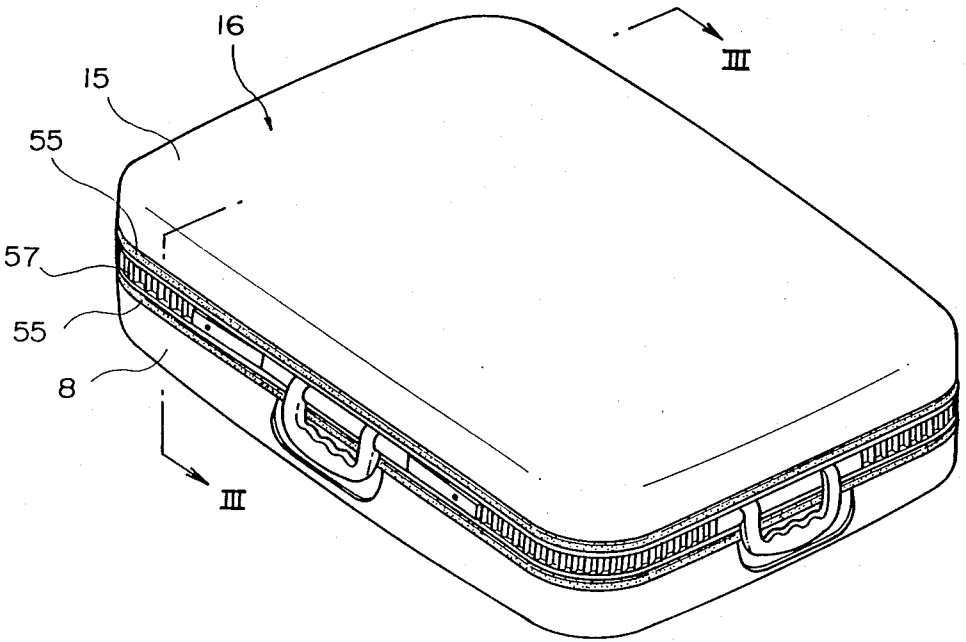
FIGS. 1–5 show a suitcase based on the present invention.
Figure 2:
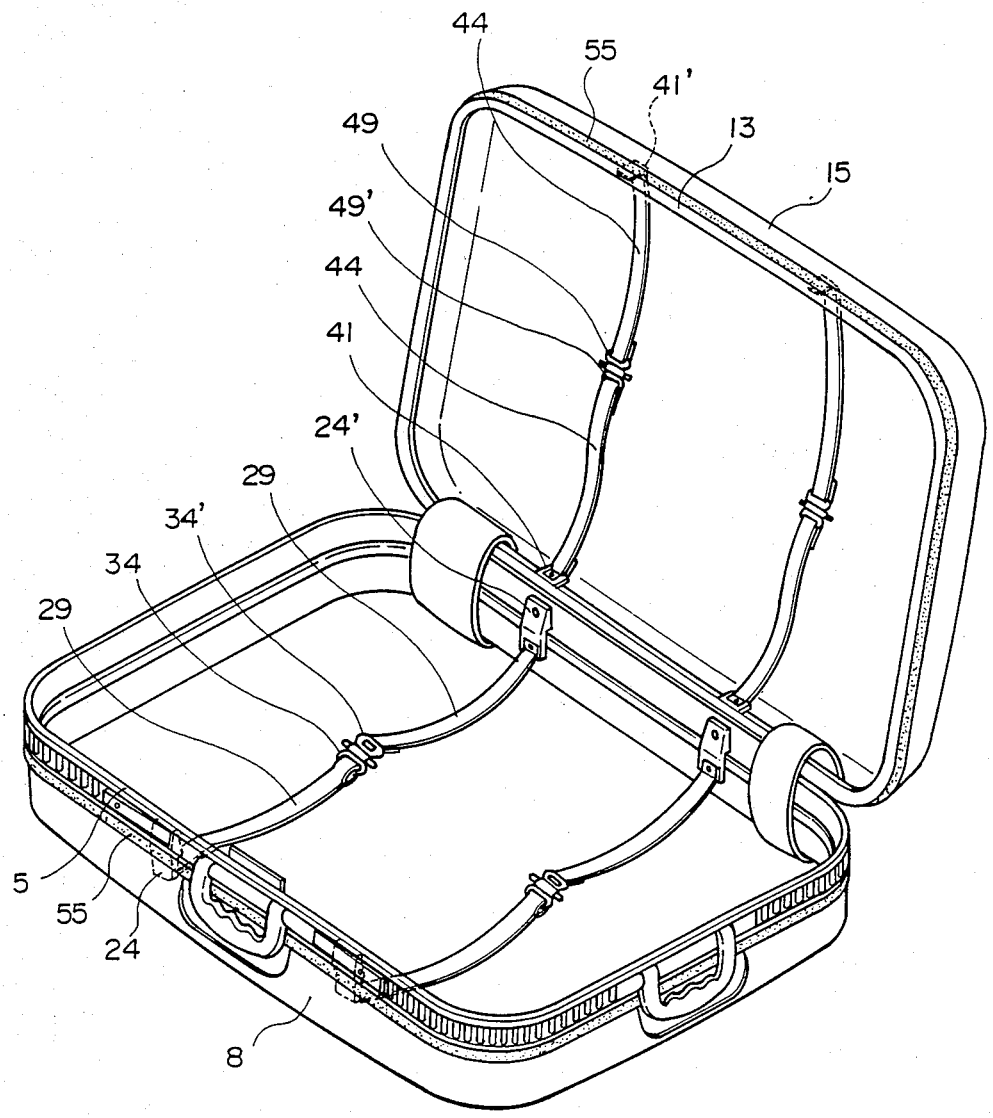
Figure 3:
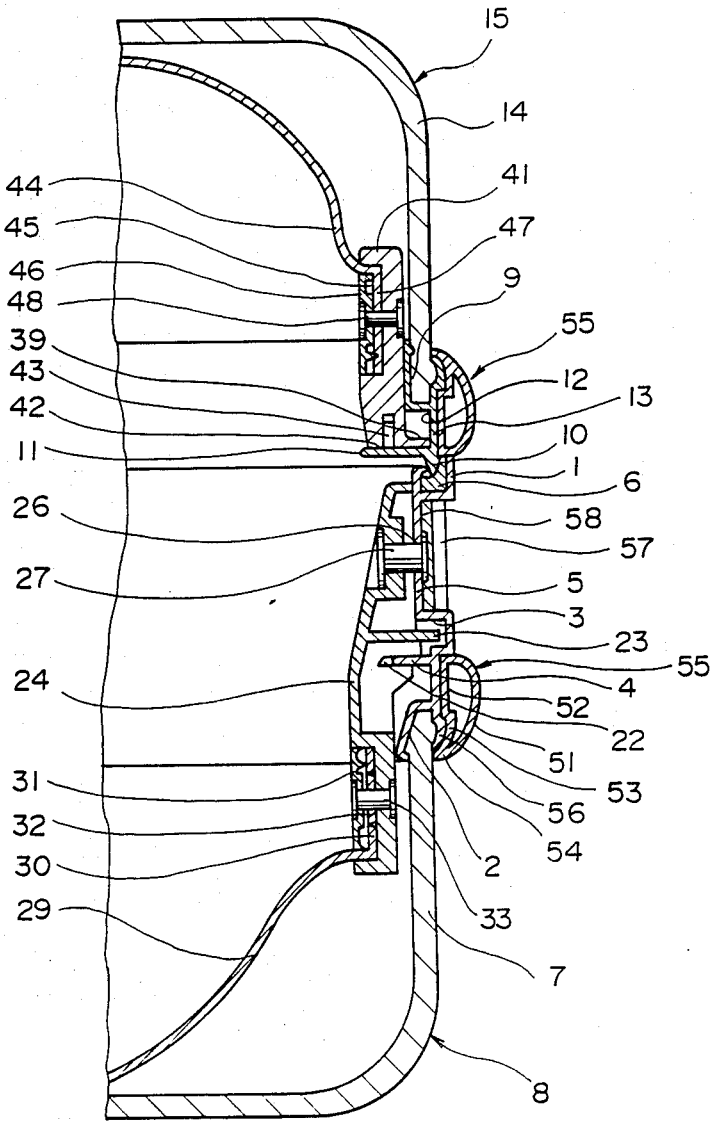
Figure 4:
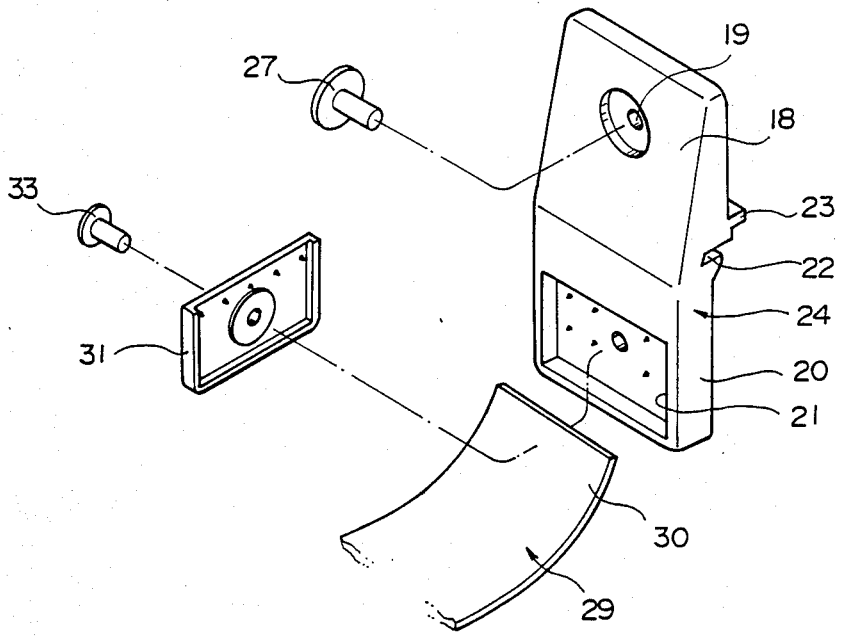
Figure 5:
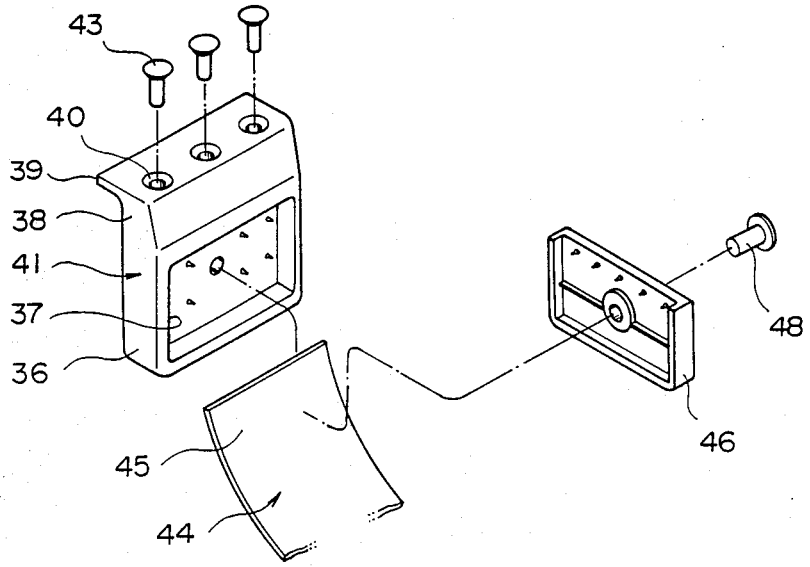

FIGS. 1 through 5 show a suitcase based on the present invention. A body side part 8 of this suitcase comprises a metal body member peripheral frame 5 provided with a U-shape groove 1 upwardly directed on the upper periphery, a downwardly directed U-shape groove 2 at the lower periphery, an inwardly directed U-shape groove 3 at a position of an intermediate height and an inwardly directed butt plate 4 at a position slightly lower than the above. In the bottom portion of the upwardly directed U-shape groove 1, an elastic material paper string 6 is installed. Besides, a deep dish-like body member 7 is composed of a hard plastic material. The open mouth periphery of this body member 7 is engaged with the downwardly directed U-shape groove 2 while attaching the peripheral frame 5 onto the body member 7.

A lid side part 15 comprises a metal lid member peripheral frame 13 provided with an upwardly directed U-shape groove 9 at the upper fringe, a downwardly directed butt plate 10 at the lower periphery, an inwardly directed butt plate 11 at a position near the lower periphery and an inwardly directed U-shape groove 12 at a position of an intermediate height. Besides, a deep dish-like lid member 14 is formed with a hard plastic material. The open mouth fringe of this lid member 14 is engaged with the upwardly directed U-shape groove 9 while mounting the peripheral frame 13 onto the lid member 14.

Rear sides of said both member peripheral frames 5,13 are connected with a hinge (not illustrated) thus the lid side part 15 being hinged openably to the body side part 8.

Two pairs of hard plastic body side planar members 24, 24' are provided with mounting holes 19 at outer end portions 18, large square recesses 21 on the outer surface of inner end portions 20 and mounting grooves 22 and mounting ridges 23 at intermediate positions. These body side planar members 24, 24' are arranged in the front and rear side of said peripheral frame 5, thereby engaging an inwardly directed U-shape groove 3 with mounting ridge 23 and an inwardly directed butt plate 4 with mounting groove 22. Thus an outer end portion 18 and a portion near the inner end of said body side planar members 24, 24' are made in contact with the rear surface in the upper and lower portions. In addition, a rivet hole 26 with previously drilled through the body member peripheral frame 5 while communicating with a mounting hole 19, through which a crimp rivet 27 is inserted and crimped thus body side planar members 24, 24' being fixed opposedly to the body member peripheral frame 5.

An end portion 30 of a flat inner strap 29 is dropped into said square recess 21 of these body side planar members 24, 24'. In addition, a hard plastic clamp plate 31, slightly smaller than square recess 21, is attached to the outside of said end portion 30. Then the bottom wall of recess 21 and a drop-in portion 32 and clamp plate 31 are fixed together with a screw 33. Thereby, the end portion 30 of inner strap 29 is connected to each of the body side planar members 24, 24'. Detachable tight fittings 34, 34' are mounted at tops of inner strings 29.

Two pairs of hard plastic lid side planar members. 41, 41' are provided with large square recesses 37 in the outer surface of inner end portions 36 and lateral ridges 39 and mounting holes 40 on the lower surfaces of outer end portions 38. When these lid planar members 41, 41' are mounted on the front and rear surface of said lid member peripheral frame 13 with lateral ridge 39 engaged with inwardly directed U-shape groove 12, thereby the lower surface of lateral ridge 39 is engaged with the upper surface of inwardly directed that plate 11 while contacting outer end portion 38 with the rear surface of lid member peripheral frame 13. Then lid side planar members 41, 41' are fixed opposedly to the lid member peripheral frame 13 by inserting crimp rivets 43 through rivet holes 42 and mounting holes 40 which were previously drilled in the inwardly directed butt plate 11 while communicating with the mounting holes 40, and crimping the rivets 43.

End portions 45 of the flat inner strap 44 are dropped in the square recesses 37 of these lid side planar members 41, 41'. Hard plastic clamp plates 46, slightly smaller than the square recesses 37, is attached to said end portions 45 while fixing together the bottom wall of recesses 37, drop-in portions 47 of the inner string 44 and the clamp plates 46 by means of screws 48. Thus, end portions 45 of the inner string 44 are connected to lid side planar members 41, 41'. At the top end of each inner string 44, detachable tight fittings 49, 49' are installed.

A hollow frame protector 55 is made of semi-hard plastic material. The outer wall 51 of this protector is formed in an arc, while the inner wall 52 showing a straight line shape with a positioning groove 53. On the outer fringe, there is a ridge 54 formed in extension from the outer wall. The inner wall 52 of this protector 55 is attached to the outer surface of an upper side portion of the body member peripheral frame 5 and the outer surface of the lid member fringe frame 13, while also engaging the positioning groove 53 with positioning ridges 56 provided on each frame 5, 13. Thus, said protector 55 is attached around the entire periphery of each frame 5, 13 and stuck thereon.

A semi-hard plastic band ornament 57, with wavy undulation on its outer surface, is engaged with and stuck to a band recess 58 equipped on the outer surface of a lower portion of body member peripheral frame 5.

Said suitcase can effectively avoid biased sticking of the protector while not requiring high skills for positioning the protector before sticking operation. Positioning is done in one operation unless particular trouble occurs. Therefore, an adhesive will not be coated on unnecessary portions, eliminating disadvantageous removing work of the adhesive. It also never occurs that the trace of peels remains degrading commercial value of the suitcase.

In addition, the appearance is much improved while tightly supporting the contents by making a space between a bottom wall of the body member for the ceiling wall of the lid member and the inner strap narrower.

Figure 6:
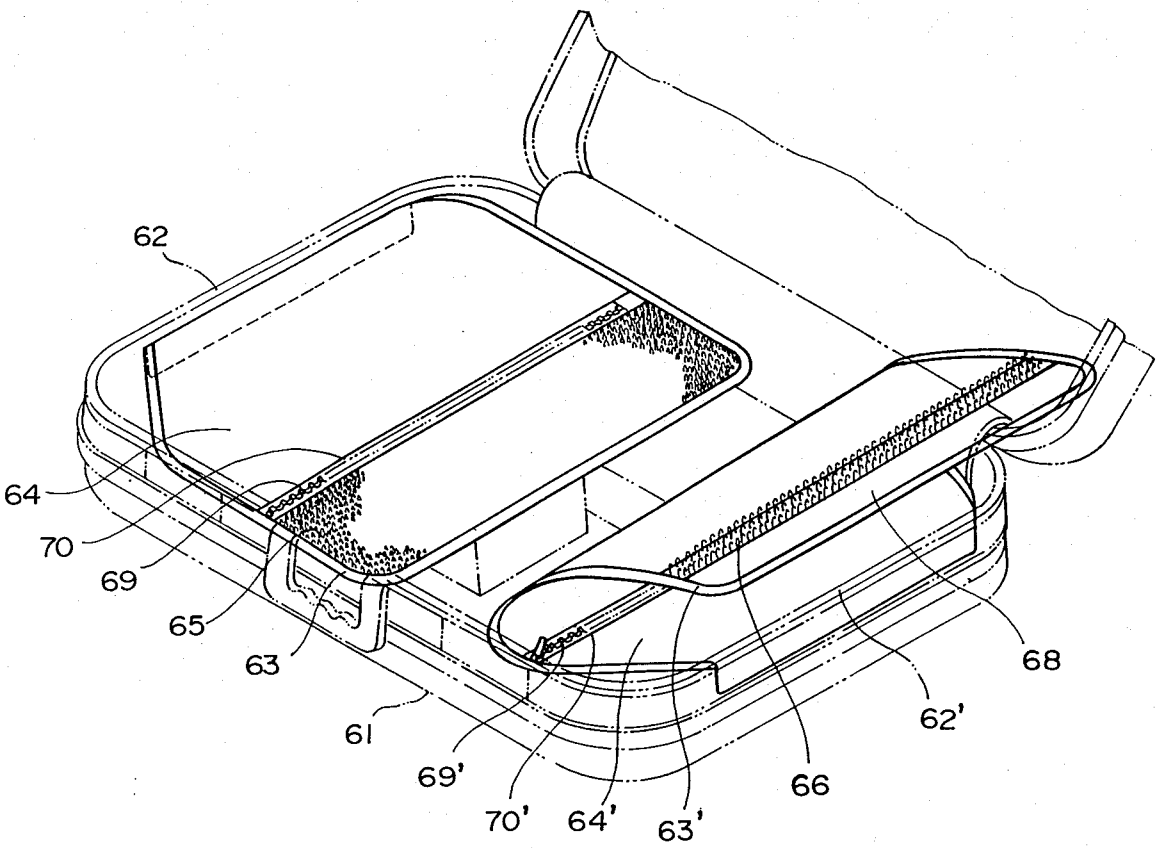
FIG. 6 is an oblique view of an opened inner lid device of a suitcase according to the present invention.
Figure 7:
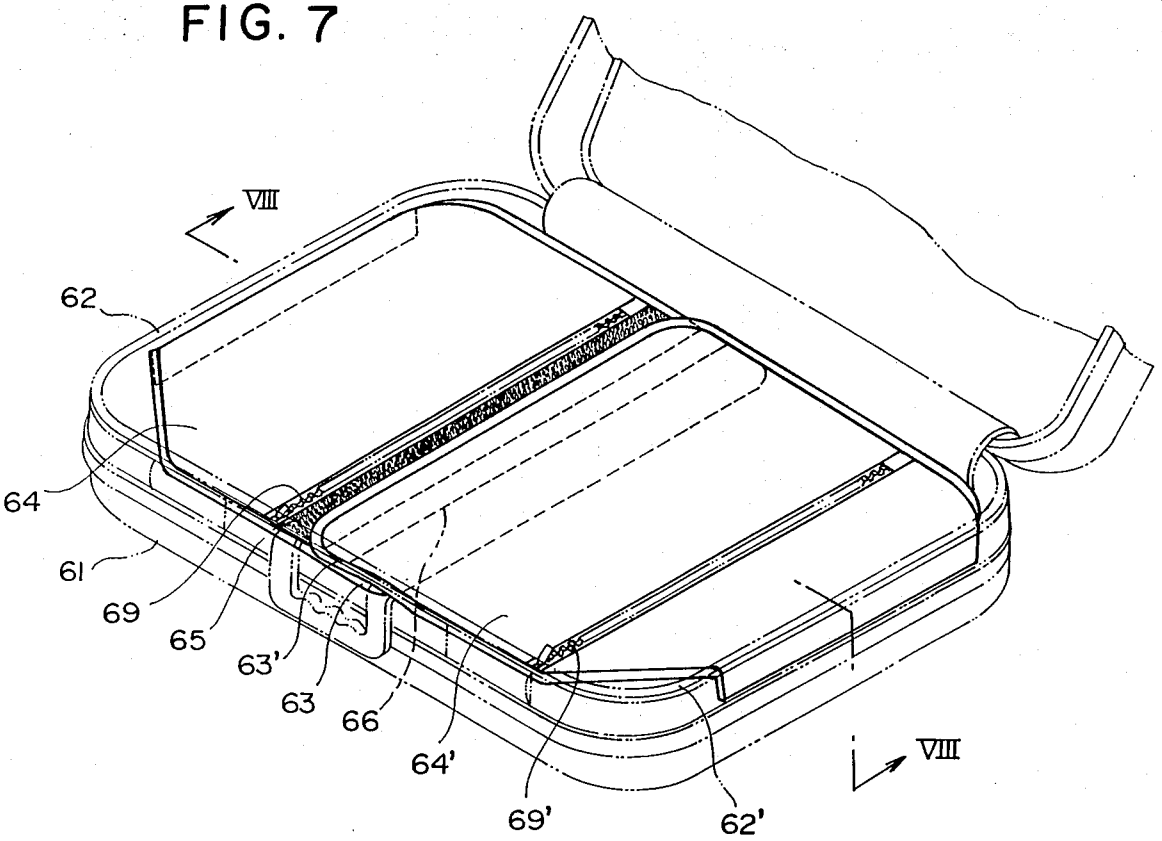
FIG. 7 provides an oblique view of the inner lid device of FIG. 6 in a state of closure.
Figure 8:
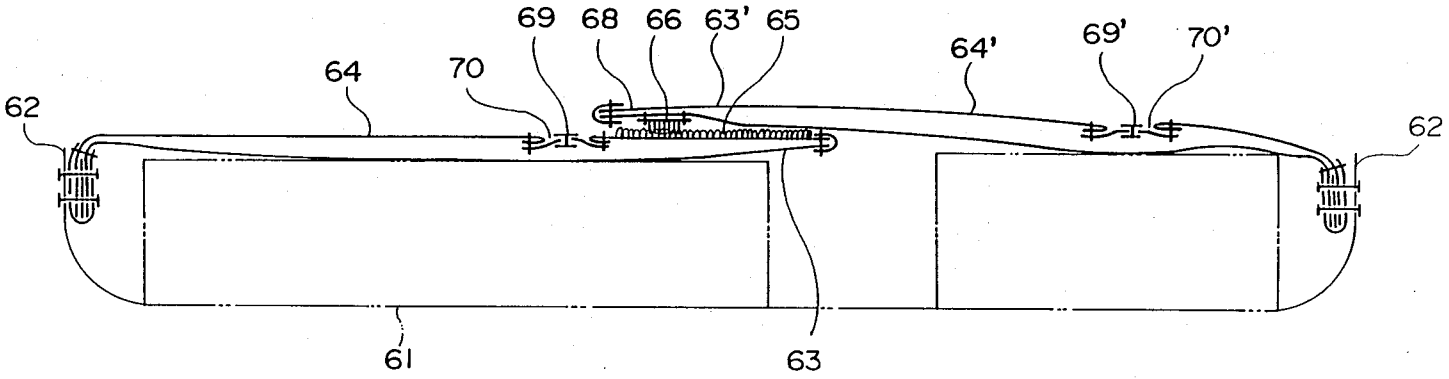
FIG. 8 is a sketch of a section along line VIII—VIII of FIG. 7.
Figure 9:
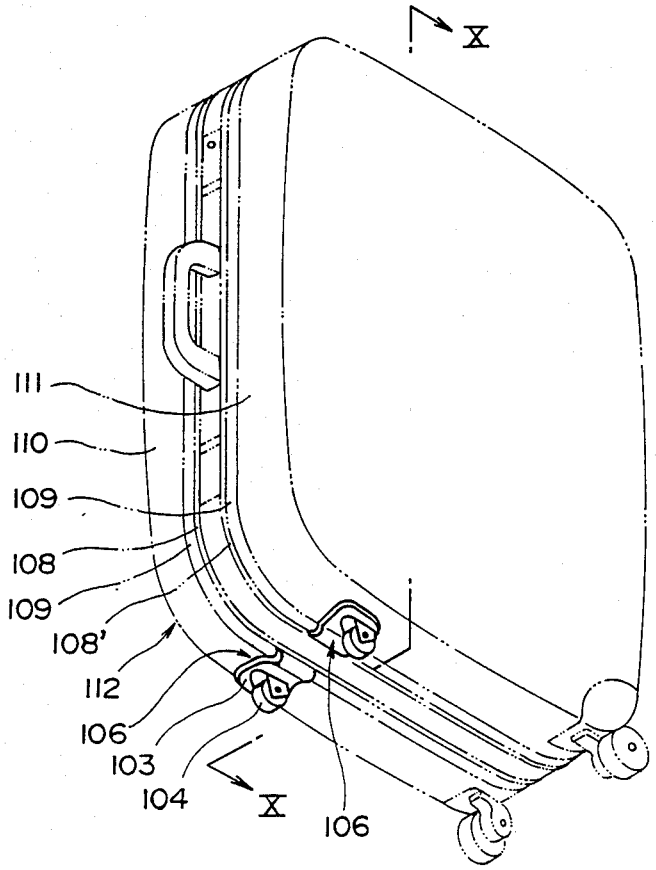
FIG. 9 shows an oblique view of the entire suitcase equipped with a castor based on the present invention.
Figure 10:
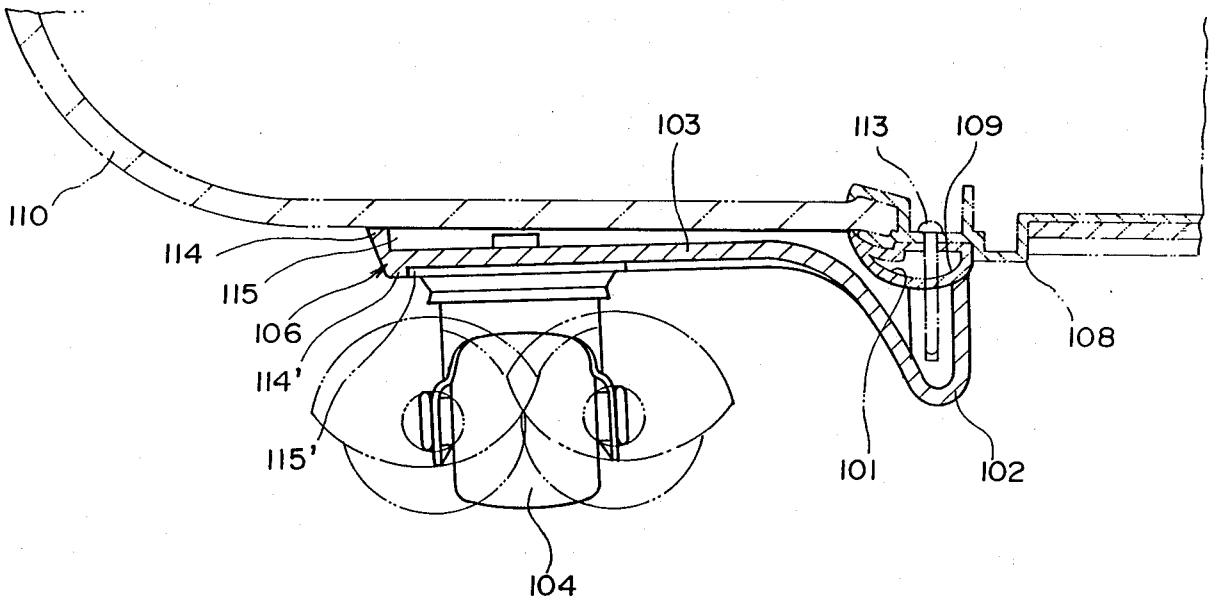
FIG. 10 is a sectional view of line A—A of FIG. 9.
Figure 11:
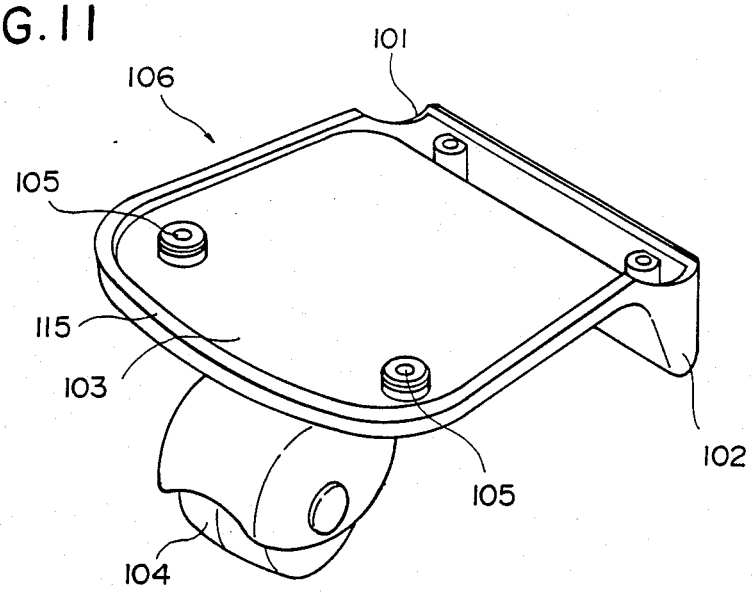
FIG. 11 gives an oblique view of a castor.
Figure 12:
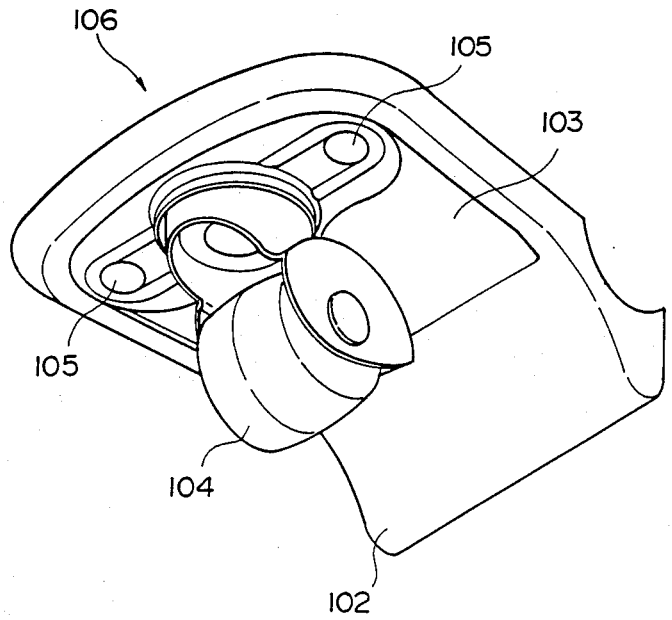
FIG. 12 gives an oblique view of a castor.

FIGS. 6 through 8 show an inner lid device of a suitcase according to the present invention.

In a suitcase body 61 with a lid 68, a pair of inner lid plates 64, 64' are mounted with their end peripheries fixed onto open mouth peripherier 62, 62', in which top end peripheries 63, 63' are overlapped in closed state of the suitcase.

At the top end peripheral portion 63 of the inner lid plate 64, there is a wide female planar fastener 65. At top fringe portion 63', a narrow male planar fastener 66 is mounted for engagement with the planar fastener 65. The narrow male planar fastener 66 is located slightly in the center side from the top of the narrow male planar fastener 66.

Accordingly, a position for engaging the narrow male planar fastener 66 with the wide female planar fastener 65 is made variable within a range of the width of the wide female planar fastener 65. Consequently, the quantity of overlapping top end fringe portions 63, 63' is freely controlled.

Said inner lid plates 64, 64' are constructed as pockets for housing small articles, opened and closed by means of slide fasteners 69, 69' as entrances 70. 70'.

Said inner lid device provides much simpler and easier changing operations for engagement position than conventional male/female hooks, strings for belts, bringing about a higher practical advantage.

FIGS. 9 through 12 show a suitcase with castors improved and attached by an improved means of the present invention. According to this embodiment of a suitcase, dish-shaped body member 110 and lid member 111 are composed of a hard plastic material. At open mouth peripheries of said body and lid members 110, 111, a metal body member mouth frame 108 and a metal lid member mouth peripheral frame 108' are mounted.

Rear sides of said both frames 108, 108' are connected with a hinge (not illustrated) thus forming a suitcase body 112 in which a body member 110 is hinged openably with a lid member 111.

Semi-hard plastic protectors 109, each formed with a tray-like outer surface, are attached on the entire surfaces of frames 108, 108'.

On the upper surface of the end fringe portion, a generally square and round cornered semi-hard plastic planar board 103 is provided, said board comprising a groove portion 101 in the same shape has the outer surface of the protector 109 and an inverted mountain-shape ridge 102 of the lower surface of the end peripheral portion.

A castor body 106 is formed by fixing castors 104 onto the lower surface of this board 103 near its top portion by means of screws 105.

The castor body 106 is fixed on the outer surface of the ground contact side wall in the body and lid members 110, 111, thereby making its outer surface come in contact with the upper surface of the board 103 while also engaging the recess portion 101 with the protector 109.

With frames 108, 108' and protectors 109, mounting screws 113 are screwed in from the inside of frames 108, 108' into positions corresponding to said recess portions 101, while tops of said mounting screws 113 are screwed into the bottom surface of recess portions 101, thus castor bodies 106 being fixed onto body member 110 and lid member 111.

In these figures, numbers 114, 114' show ridges and 115, 115' indicate recesses.

With the embodiment of a suitcase based on the present invention, there are planar boards 103 which can effectively cushion shocks when placing the suitcase on the ground while protecting the case from damages.

When protectors 109 and planar boards 103 are subject to external force, the force will not be transmitted easily to the screw portion of mounting screws 113 because the cushion function of protectors 109 and planar boards 103 absorbs the external force. Therefore, completely no such accidental troubles will occur that mounting screws 113 become loose.

In addition, the engagement between recess portion 101 and protector 109 can very advantageously prevent any rotation of a planar board 103. In addition, the security of screwed-in mounting screws 113 is protected; by providing mountain-shape ridges 102.

Figure 13:
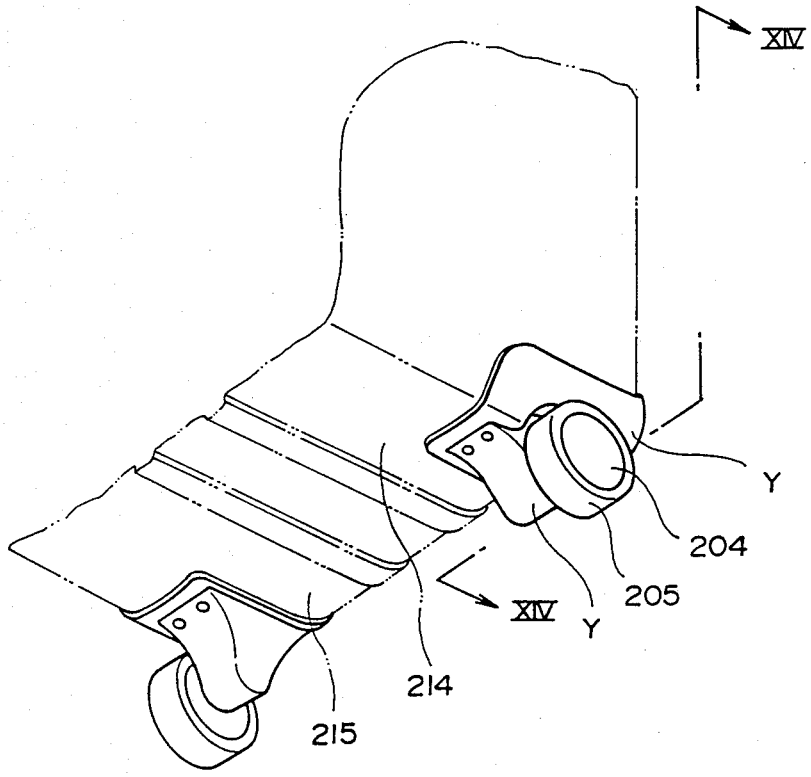
FIG. 13 is an oblique view for showing an entire rear wheel device for a suitcase according to this invention.
Figure 14:
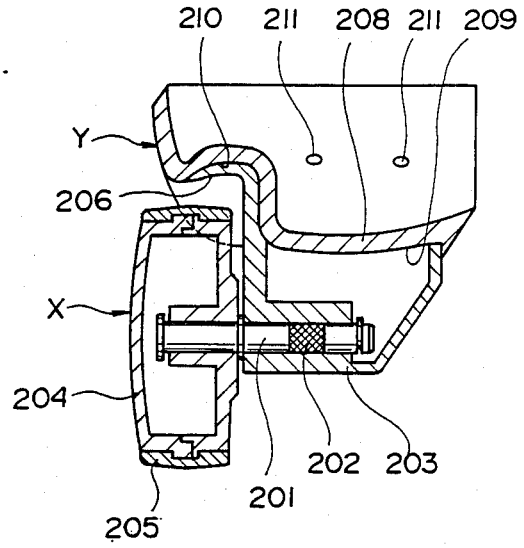
FIG. 14 is a sectional view along line XIV—XIV of FIG. 13.
Figure 15:
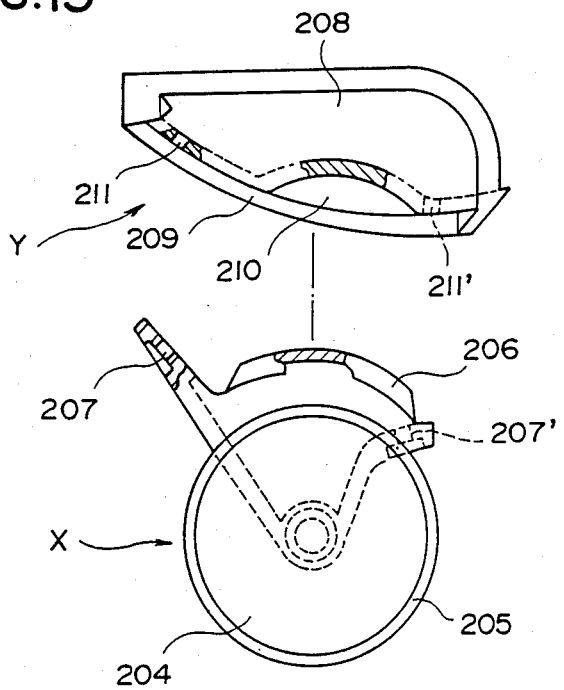
FIG. 15 gives a partial cutaway side view of a rear wheel device.

FIGS. 13 through 15 shows an embodiment of a rear wheel device for a suitcase according to the present invention.

With the rear wheel device of this embodiment, the periphery of an end portion in a metal axle 201 is provided with a knurled portion 202 around which a hard plastic bearing 203 of an inverted triangular column is covered by insertion.

A hard plastic wheel 204 is bearingly supported at the top of axle 201, around which there is a soft plastic tire 205 mounted.

The bearing 203 is provided with integratedly protruded eaves-like protrusion portion 206 at a position above the tire 205. In addition, mounting holes 207, 207' are equipped in both sides of the axle 201. Thereby, a horizontal axle type castor (X) is constituted. In addition, there are a drop coupling recess 209 for said bearing and an escape recess 210 for eaves-like protrusion portion 206 at the lower surface of a hard plastic main panel 208 having a shape conforming to the outer surface of the rear side corner in body and lid members 214, 215 located in the upper part of a suitcase body.

A protector (Y) is formed by providing throughholes 211, 211' which communicate with mounting holes 207, 207' at positions corresponding to mounting holes 207, 207' for the bearing 203 where it is engaged with drop coupling recess 209.

The upper surface of main panel 208 is made in contact with the outer surface in the rear side corner of body and lid members 214, 215 while engaging bearing 203 in drop coupling recess 209 of said main panel 208. In addition, eaves-like protrusion portion 206 is engaged in escape recess 210. Furthermore, tops of mounting screws 217, 217' are screwed into body and lid members 214, 215 through mounting holes 207, 207' and throughholes 211, 211'. Thus the castor (X) and the protector (Y) are mounted.

With the rear wheel device of a suitcase of this embodiment, there is a cushion function for solving the foregoing problems, by means of protectors (Y) and a tire 205 of castor (X) positioned between body and lid members 214, 215 and bearing 203.

In particular, a protrusion portion 206 can effectively prevent damage in a portion which supports the axle 201 in a so-called cantilever type. In addition, the portion 206 can function as a bumper when the tire comes in contact with the protrusion portion 206 due to a shock during use. Moreover, the protrusion portion 206 can also function as a floor covering (skirt, apron), a means for preventing the inclusion of small stones, dust, etc.

What is claimed is:

1. A suitcase comprising a castor body (106) and a suitcase body (112), said castor body comprising a castor (104) being fixed with a screw (105) on the lower surface of a portion near the top end of a square, semi-hard plastic planar board (103) having a groove portion (101) of the same shape as the outer surface of a protector (109) on the upper surface of a base end fringe portion and also said board (103) having an inverted mountain-shape ridge (102), said castor (104) being fixed by said screw (105) in a portion of said board (103), and said body and lid members (110), (111) comprising metal peripheral frames (108), (108') attached to the open mouth peripheries of said members (110), (111) and semi-hard plastic protectors (109) having an outer surface like a tray, mounted on said peripheries of said frames (108), (108'); wherein said castor body (106) arranged on the outer surface of a ground contact side wall in said body and lid members (110), (111) with the outer surface coming in contact with the upper surface of a board (103) while also engaging a recess groove portion (101) with said protector (109), mounting screws (113) are screwed in from the inside of said frames (108), (108') to secure portions corresponding to said recess groove portion (101), in said frames (108), (108') and protectors (109), whereby tops of said mounting screws (113) are screwed onto the bottom surface of said recess groove portion (101) and said castor body (106) is fixed onto said body and lid members (110), (111).

2. The suitcase according to claim 1 further comprising a second caster body along side the first mentioned castor body said second castor body of similar construction and being similarly secured to said outer surface of said ground contact side wall in said body.

3. The combination of claim 1 wherein said suitcase further comprises a rear wheel device, said caster body (106) being secured to a front end of said suitcase, said rear wheel device including a hard plastic bearing (203) mounted on an axle (201), said bearing (203) having a triangular shape, a hard plastic wheel (204) rotatably supported on said axle (201), a soft plastic tire (205) surrounding said wheel (204), a protrusion (206) provided integrally with a portion (206) immediately above said tire (205), and mounting holes provided on both sides of said axle (201) in said bearing (203), a protector (Y) comprising a soft plastic main panel (208) having a shape at the upper surface engageable with the other surface on the rear corner of the suitcase body, a recess (209) formed in the lower surface of said main panel (208) for housing said bearing (203), said panel (208) having holes (211) so arranged that when said bearing is housed in said recess (209), said holes (211) communicate with said mounting holes 207, for supporting said bearing (203).

* * * * *

UNITED STATES PATENT AND TRADEMARK OFFICE

CERTIFICATE OF CORRECTION

PATENT NO. : 4,854,602

DATED : August 8, 1989

INVENTOR(S) : Tado Takeuchi

It is certified that error appears in the above-identified patent and that said Letters Patent is hereby corrected as shown below:

On the title page, item [30], delete all Priority Data and the

Priority of the following Japanese Applications should be noted:

3,443/1987 - filed January 13, 1987
29,656/1987 - filed February 28, 1987

Signed and Sealed this

Thirtieth Day of October, 1990

*Attest:*

HARRY F. MANBECK, JR.

*Attesting Officer*

*Commissioner of Patents and Trademarks*